United States Patent [19]

Montgomery David W.

[11] Patent Number: 5,031,373

[45] Date of Patent: Jul. 16, 1991

[54] ETCHING MACHINE AND METHOD

[76] Inventor: Montgomery David W., P.O. Box 15521, Chesapeake, Va. 23320

[21] Appl. No.: 428,078

[22] Filed: Oct. 27, 1989

[51] Int. Cl.[5] ..... B24B 1/00; B24C 1/00; B24C 3/00; B24C 5/04

[52] U.S. Cl. ..... 51/317; 51/319; 51/410; 51/439

[58] Field of Search ..... 156/345, 640, 641, 645, 156/663; 51/317, 319, 410, 439

[56] References Cited

U.S. PATENT DOCUMENTS 3,898,768 8/1975 Gilbert et al. ..... 51/439 X 4,769,956 9/1988 Wern ..... 51/410 X

*Primary Examiner*—William A. Powell

*Attorney, Agent, or Firm*—Wegner, Cantor, Mueller & Player

[57] ABSTRACT

An etching machine for etching a material such as glass or crystal includes a blast unit having a plurality of grit guns. The position of the grit guns relative to the material to be etched is individually adjustable prior to initiation of the etching operation. This adjustment is provided by mounting each pair of grit guns on a support, so that the grit guns are pivotable relative to the support. Additionally, each support is slidable along a track, so that the position of the grit guns is also adjustable along the length of the track. Once the adjustment is facilitated, the grit guns are locked in place. The compressed air and grit feeds to each grit gun are also independently adjustable. In this way, the machine requires no parts which move during the actual etching operation, thus significantly enhancing reliability, accuracy and safety.

11 Claims, 4 Drawing Sheets

ETCHING MACHINE AND METHOD

BACKGROUND OF THE INVENTION

Prior etching machines use one of two techniques. The first technique employs a stationary blast unit, and the operator must rock the material to be etched, such as a glass plate, back and forth in the path of the grit guns. The second technique utilizes a blast unit in which all the grit guns are movable as a whole. These techniques have not proven satisfactory; both are unreliable and do not provide precision control of the etching process. The first introduces human error into the etching process, while the second requires precise mechanical motion control for the blast unit. Moreover, using conventional etching machines, it is not possible to adjust the individual grit guns relative to the material to be etched.

SUMMARY OF THE INVENTION

The present invention overcomes the above disadvantages and provides a machine for etching glass, crystal or the like providing increased control and greater safety. The etching machine in accordance with the present invention has no parts which move during the etching operation, thus improving the reliability of the machine. The etching machine allows fine adjustment of position and timing, permitting etching operations with much higher precision than previously possible.

DETAILED DESCRIPTION OF THE PREFERRED EMBODIMENTS

Figure 1:
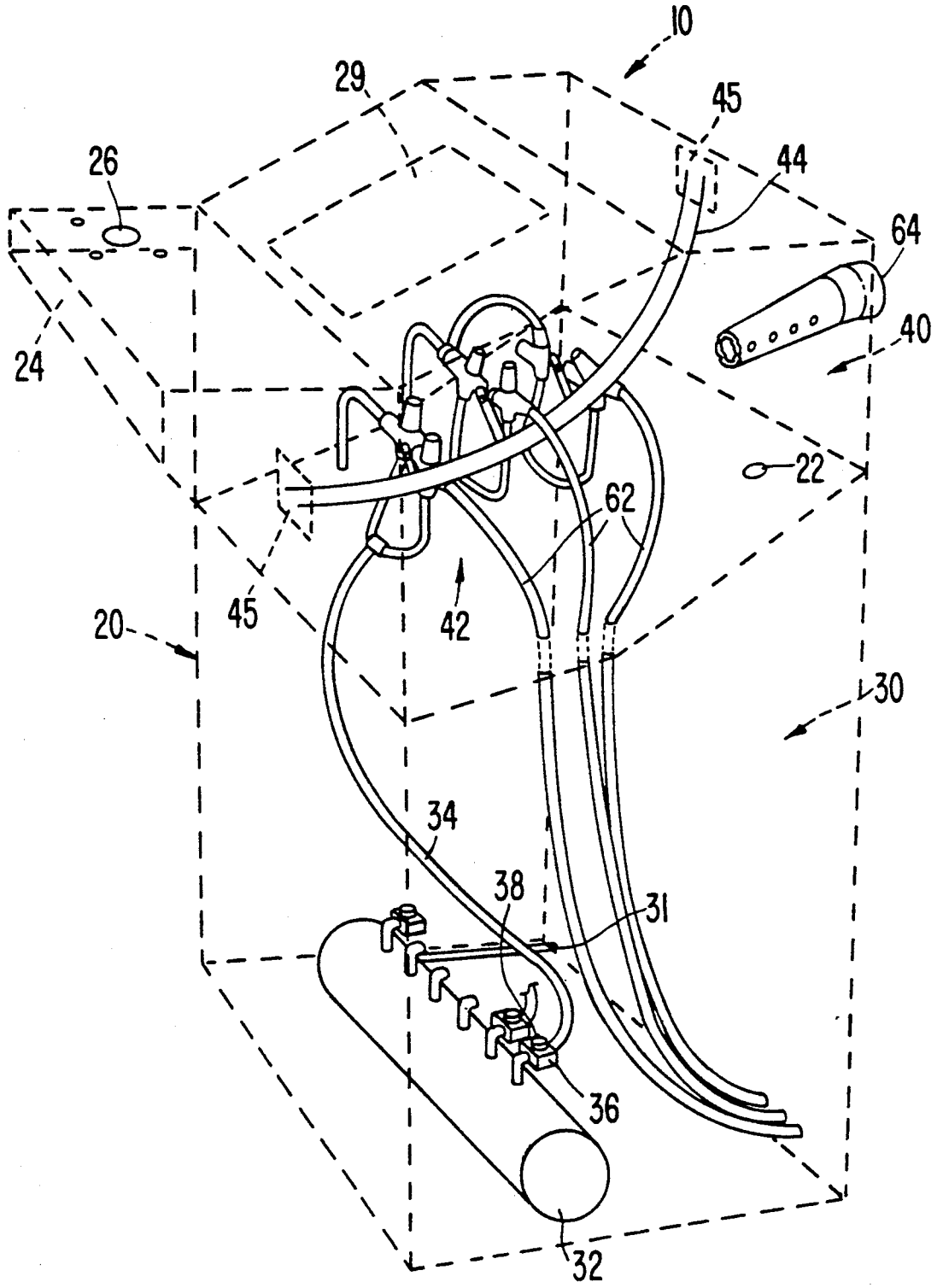
FIG. 1 is a perspective view of the etching machine in accordance with a preferred embodiment of the present invention, with the housing of the device illustrated in phantom.

An etching machine in accordance with a preferred embodiment of the present invention is illustrated in FIG. 1 and generally designated 10. Throughout the figures, like numerals are used to illustrate like elements.

Etching machine 10 includes a housing 20 having compressor chamber 30 and blast chamber 40, separated by divider wall 22. A control panel 24 having master power switch 26 is coupled to the housing. The machine may be manually operated through the use of start button (not shown) and a foot switch 28 (shown in FIG. 2), although it is preferably computer controlled via a CPU (not shown), in which case start button and foot switch 28 are unnecessary. The upper face of the housing 20 has an etching window 29 formed therein for holding the material to be etched, such as a sheet of glass or the like. The window 29 positions the glass sheet over the grit blast unit 42 for etching, as will be described in more detail below.

A compressed air storage tank 32 is located in the compressor chamber 30, and is connected to an external air compressor 50 (see FIG. 2) via an air feed line 31. A plurality of air lines 34 extend from the compressed air storage tank to the grit blast unit 42 located in the blast chamber. Suitable apertures are formed in divider wall 22 to permit passage of the air lines from the compressor chamber into the blast chamber.

Each air line 34 is connected to the compressed air storage tank 32 via an air valve 36 and a solenoid 38 which, in turn, are connected via power relay 27 to the control switches. Solenoids 28 are controlled by sequential timing devices 25, which are actuated either manually or via computer. In the preferred embodiment shown in FIG. 1, six air valve/solenoid hook-ups are shown, although, for the sake of simplicity and clarity, only one corresponding air line is illustrated. Of course, although the device preferably employs six air lines, it is understood that the number of air lines can be varied, depending on the number of grit guns required for a particular etching purpose, the size and capacity of the casing, and the like.

Figure 2:
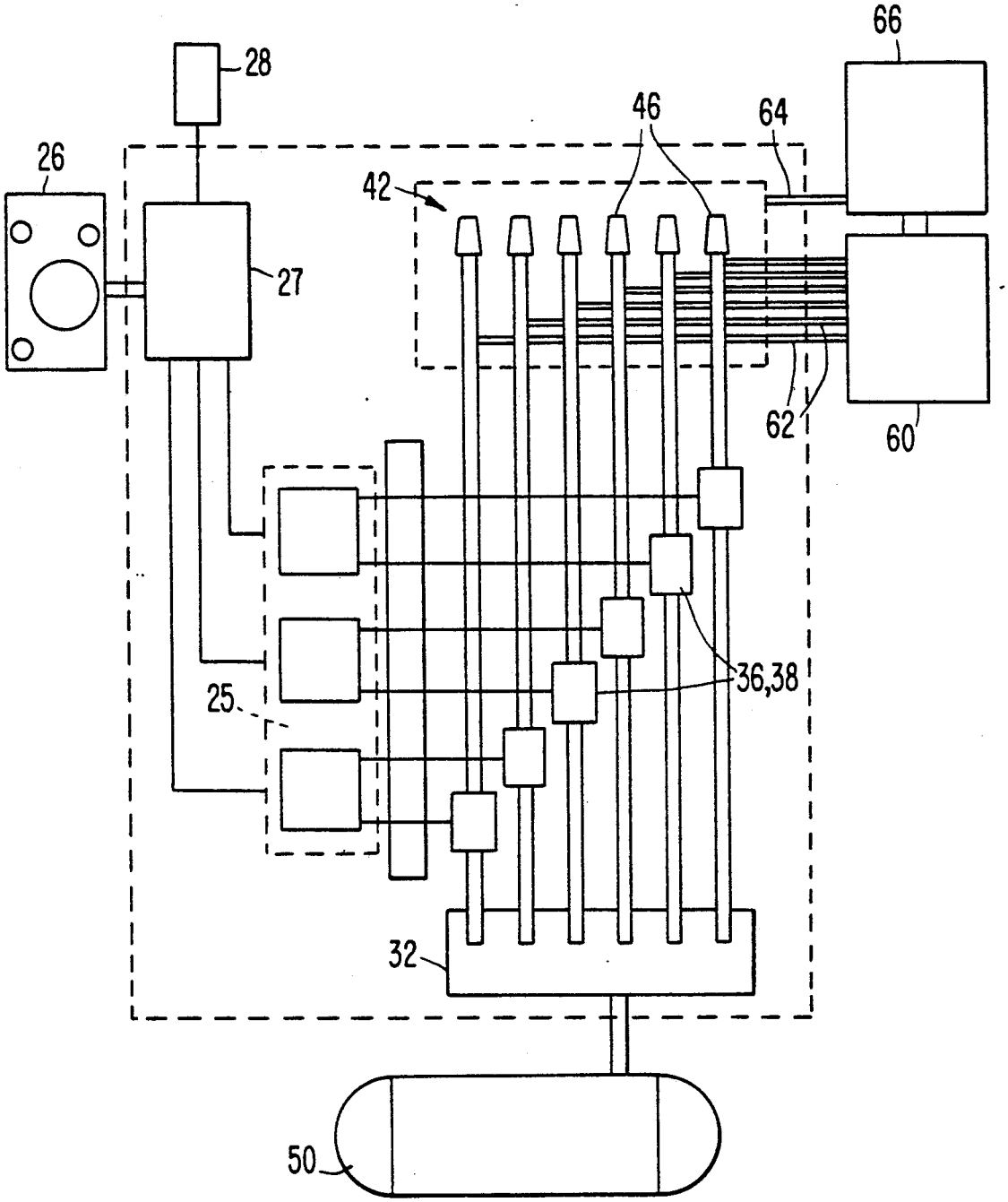
FIG. 2 is a block diagram depicting the operation of the etching machine of FIG. 1.
Figure 3:
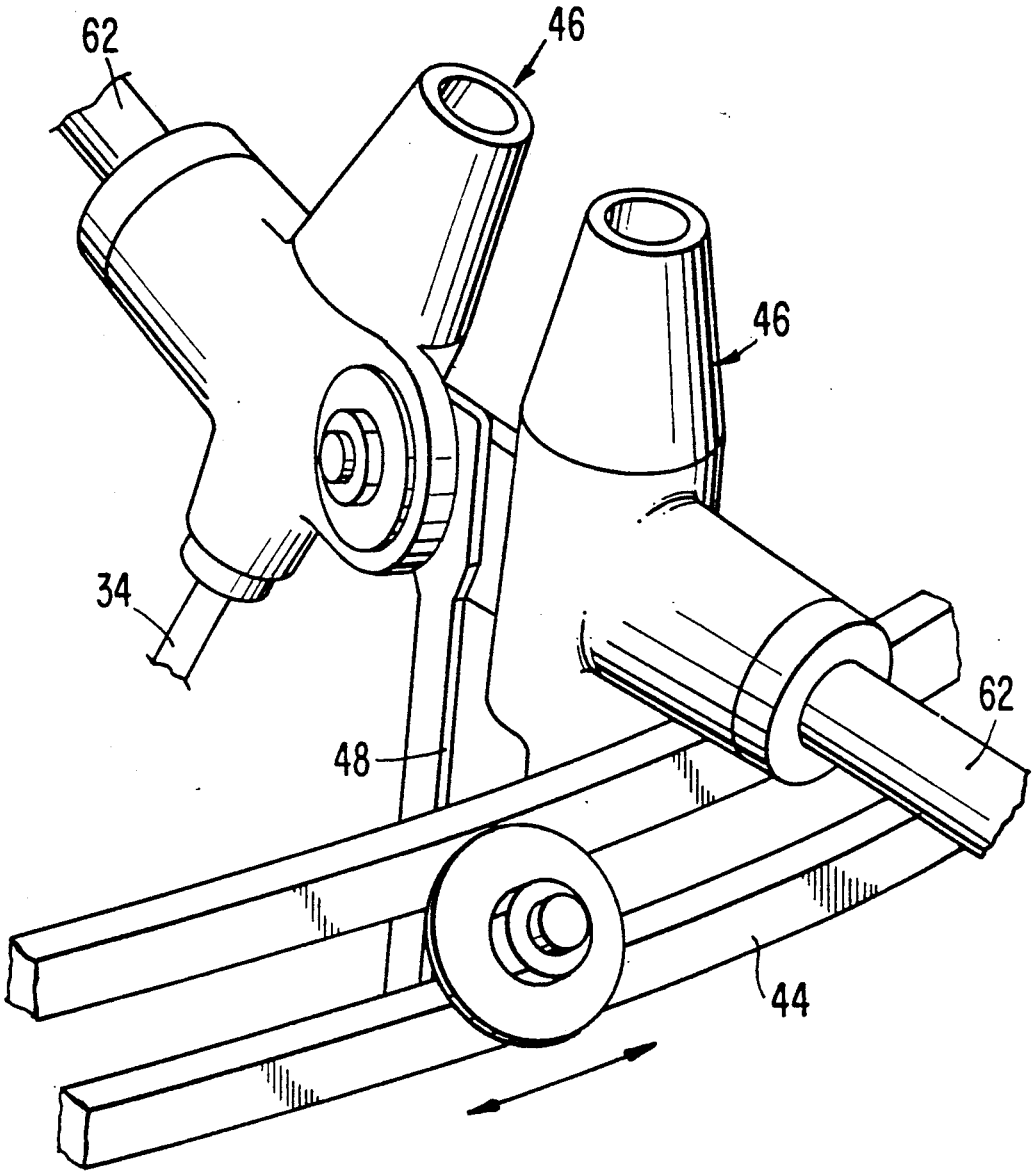
FIG. 3 is a partial perspective view of the grit blast unit used in the etching machine shown in FIG. 2.

A plurality of grit supply lines 62 extend from external grit reclamation/distribution system 60, shown in FIG. 2, through the compressor chamber 30, into blast chamber 40 and connect with grit blast unit 42. Grit reclamation/distribution systems suitable for use in the present invention are well known in the art, such as those manufactured by Empire Abrasive Equipment Corporation, of Langhorne, Pa. Suitable apertures are formed in divider wall 22 to permit the passage of the grit supply lines from the compressor chamber into the blast chamber. In the preferred embodiment shown in FIG. 1, six grit supply lines corresponding to the six grit guns are used, but the invention is in no way limited to that number, as discussed previously. Additionally, vacuum return line 64 extends from the blast chamber, through an aperture in the wall of housing 20, to eternal vacuum system 66, as shown in FIG. 2. The operation of vacuum system 66 and grit reclamation/distribution system 60 will be discussed in detail below.

Figure 4:
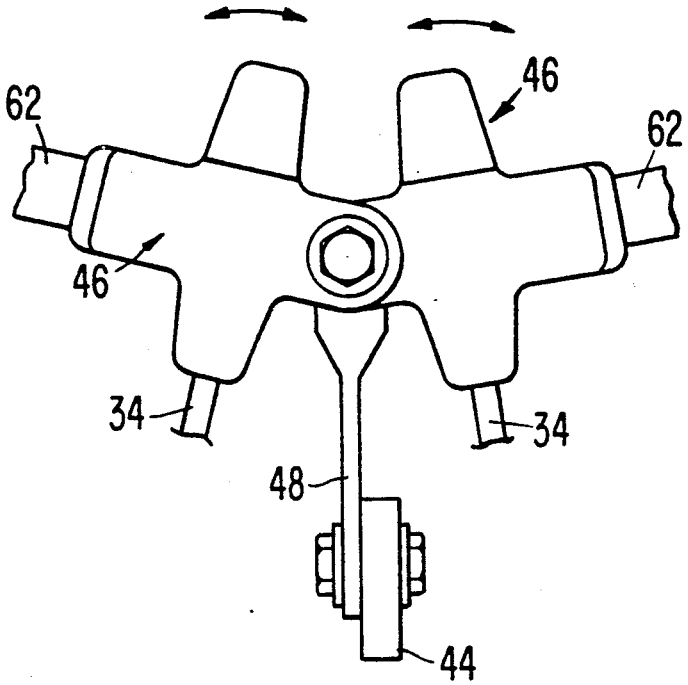
FIG. 4 is a side elevational view of the grit blast unit shown in FIG. 3.

The particular grit blast unit used in a preferred embodiment of the present invention will now be explained with reference to FIGS. 1 and 3–5. Grit blast unit 42 includes a curved track 44 mounted in a suitable manner, such as via bar mounts 45, between two opposing side walls of the housing 20. A plurality of grit guns 46 are mounted along track 44. Such grit guns are also manufactured by Empire Abrasive Equipment Corporation. In the preferred embodiment illustrated in the figures, three pairs of grit guns are used, with each pair mounted on a support 48. Each pair of grit guns is pivotally connected to each other and corresponding support 48 via a suitable mechanism, such as the bolt and nut arrangement shown in FIGS. 3 and 4. In this way, the angular position of the grit guns with respect to the track may be adjusted, as shown in FIG. 4. Likewise, each support 48, with its pair of grit guns, is movably mounted on track 44 via a similar bolt and nut arrangement, to facilitate adjustment of the position of the grit guns along the length of the track. Finally, the aperture of each of the grit guns is adjustable in a conventional manner.

Figure 5:
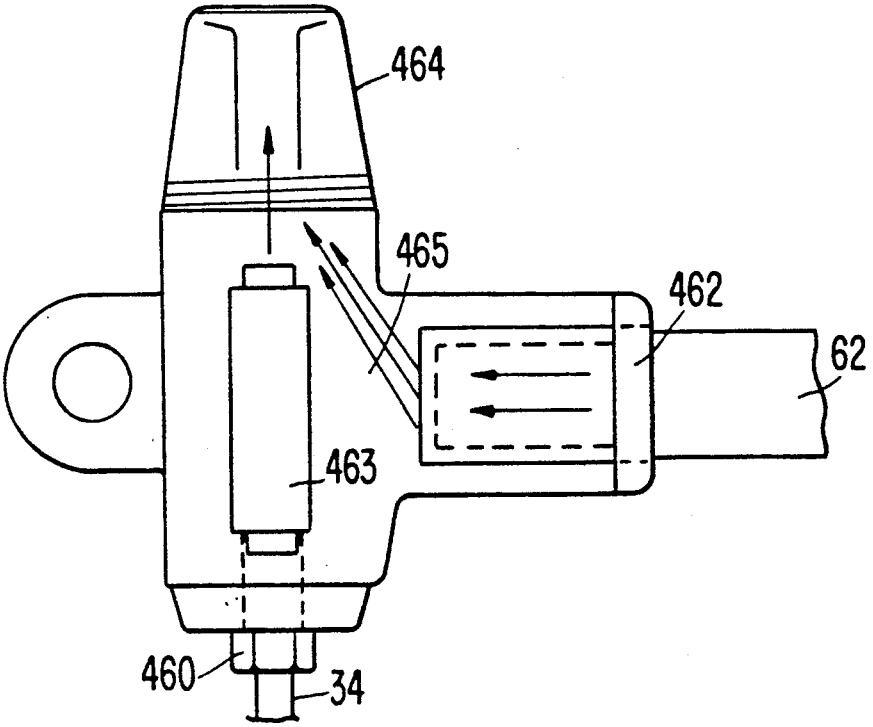
FIG. 5 is a side cutaway view of one of the nozzle units used in the grit blast unit shown in FIGS. 3 and 4.

The particular grit gun 46 used in a preferred embodiment is illustrated in FIG. 5. The grit gun includes an air intake port 460 adapted to connect with one of the air lines 34 and a grit intake port 462 adapted to connect with one of the grit supply lines 62. An air hose 463 directs the air flow from the air line 34 to a screw-on nozzle tip 464. A venturi valve is formed between the inner end of grit supply line 62 and the end of air hose 463, which causes the grit and air to mix and be expelled out the opening in the nozzle tip.

To begin an etching session with the machine in accordance with the present invention, the master power switch 26 located on the control panel 24 must be turned on. This establishes a "ready-state", which starts the external vacuum system so that the machine awaits user action. The crystal, or glass object is then placed in the etching window. In a first preferred embodiment utilizing manual user control, the user presses the foot switch 28 and then the start button. The provision of two switches is a safety feature that requires both signals before the etching operation can begin. In a second preferred embodiment, a computer initiates and controls the etching operation. The machine automatically shuts off at the end of each programmed etching cycle.

In operation, the position, direction and aperture of the grit guns having been set, the etching operation is initiated. Air from the compressor 50 is stored temporarily in the compressed air storage tank 32. Compressed air is forced through the air lines 34 to the grit guns 46. Air valves 36 and solenoids 38 control which grit gun 46 fires, and for how long. Solenoids 38 are in turn controlled by sequential timing devices 25 which are connected to a power relay 27. In the second preferred embodiment of the present invention, the sequential timing devices 70 are controlled by the CPU. Compressed air mixes with grit from the external grit reclamation/distribution system 60 within each grit gun 46, and is removed onto the etching surface. Leftover grit and air is expelled from the blast chamber 40 via the vacuum return line 64, and is separated and redistributed by the respective vacuum system 66 and reclamation/distribution system 60. Once this particular etching operation is complete, the blast unit is shut down, and the grit guns are repositioned for the next etching operation.

In this way, the present invention requires no parts which move during the actual etching operation, thus significantly enhancing reliability, accuracy and safety.

The foregoing is for illustrative purposes only. Modification can be made, particularly with regard to size, shape and arrangement of parts, within the scope of the invention as defined by the appended claims.

We claim:

1. An etching machine, comprising:

a housing;

an etching window formed in said housing to receive the material to be etched;

a blast unit having a plurality of independently movable grit guns, said blast unit being positioned so that said grit guns are aimed at said etching window;

a compressed air feeder for feeding compressed air to said grit guns;

a grit feeder for feeding grit to said grit guns;

wherein the position of said grit guns is adjusted prior to initiating an etching operation, but are maintained stationary during said etching operation.

2. An etching machine as in claim 1, wherein said compressed air feeder includes an air compressor connected via an air intake tube to a compressed air manifold, and wherein each of said grit guns are connected to said manifold via individual compressed air supply lines.

3. An etching machine as in claim 2, wherein a solenoid-controlled valve is disposed along each of said compressed air supply lines, so that the flow of compressed air to each of said grit guns can be individually controlled.

4. An etching machine as in claim 3, wherein said housing is divided into a compressor chamber and a blast chamber, said blast unit being disposed in said blast chamber and said compressed air manifold and said solenoid-controlled valves being disposed in said compressor chamber.

5. An etching machine as in claim 1, wherein a pair of said grit guns are mounted on a support, and each said support is movably mounted on a track, so that each said pair of grit guns is movable along the length of said track.

6. An etching machine as in claim 5, wherein each of said grit guns is pivotable on its corresponding support.

7. An etching machine as in claim 3, wherein said solenoid-valves are computer controlled to control the flow of compressed air to said grit guns.

8. An etching machine as in claim 3, wherein said solenoid-valves are manually controlled to control the flow of compressed air to said grit guns.

9. An etching machine as in claim 4, further comprising a vacuum port formed in said blast chamber for connecting said blast chamber to a vacuum system and a grit reclamation/distribution system.

10. An etching machine as in claim 9, further comprising a plurality of grit supply lines, so that one of said grit supply lines extends between said grit reclamation/-distribution system and each of said grit guns.

11. A method for etching a glass or crystal material said method comprising the steps of:

positioning each of a plurality of grit guns with respect to the material to be etched;

locking each of said grit guns in place;

initiating said etching operation so that grit and air selectively flows to each of said grit guns, so as to etch the material to be etched in a desired manner.

* * * * *